US006857342B2

(12) United States Patent
Wang

(10) Patent No.: US 6,857,342 B2
(45) Date of Patent: Feb. 22, 2005

(54) LOCKING PLIERS

(75) Inventor: Chao-Chi Wang, Taichung (TW)

(73) Assignee: Pang-Chung Wang, Taichung (TW)

( * ) Notice: Subject to any disclaimer, the term of this patent is extended or adjusted under 35 U.S.C. 154(b) by 7 days.

(21) Appl. No.: 10/444,025

(22) Filed: May 22, 2003

(65) Prior Publication Data

US 2004/0103766 A1 Jun. 3, 2004

(30) Foreign Application Priority Data

Dec. 3, 2002 (TW) ..... 91219695 U

(51) Int. Cl.[7] ..... B25B 7/12
(52) U.S. Cl. ..... 81/368; 81/367; 81/369
(58) Field of Search ..... 81/368, 367, 369, 81/370, 381, 382, 383, 384

(56) References Cited

U.S. PATENT DOCUMENTS 4,893,530 A * 1/1990 Warheit ..... 81/409.5

6,626,070 B2 * 9/2003 Peperkorn et al. ..... 81/370

* cited by examiner

*Primary Examiner*—Joseph J. Hail, III
*Assistant Examiner*—Alvin J. Grant
(74) *Attorney, Agent, or Firm*—Alan D. Kamrath; Nikolai & Mersereau, P.A.

(57) ABSTRACT

A pair of locking pliers includes a first jaw, a first handle, a second jaw, a second handle, a toggle, an adjusting screw, a release lever, a spring, and a soft jacket. The first handle extends from the first jaw and includes a space defined therein. The second jaw is pivotally connected with the first jaw. The second handle is pivotally connected with the second jaw. The toggle includes a first end pivotally connected with the second handle and a second end inserted into the space of the first handle. The adjusting screw includes an end driven into the space of the first handle for abutment against the second end of the toggle. The release lever is pivotally connected with the second handle. The release lever includes a first end for abutment against the toggle and a second end to be pressed by a user. The spring includes an end secured to the first handle and an opposite end secured to the second jaw. The soft jacket wraps up the second handle and the release lever.

6 Claims, 5 Drawing Sheets

LOCKING PLIERS

FIELD OF INVENTION

The present invention relates to a pair of locking pliers.

BACKGROUND OF INVENTION

Referring to FIG. 1, a pair of conventional locking pliers includes a first jaw 1, a first handle 8, a second jaw 2, a second handle 3, a toggle 4, an adjusting screw 5, a release lever 6 and a spring 7. The first handle 8 extends from the first jaw 1. The first handle 8 is hollow. The second jaw 2 is pivotally connected with the first jaw 1 by means of a rivet. The second handle 3 is pivotally connected with the second jaw 2 by means of a rivet. A first end of the toggle 4 is pivotally connected with the second handle 3 by means of a rivet. A second end of the toggle 4 is inserted into the first handle 8. The adjusting screw 5 is driven into the first handle 8. An end of the adjusting screw 5 abuts the second end of the toggle 4. An end of the spring 7 is secured to the second jaw 2. An opposite end of the spring 7 is secured to the first handle 8. Thus, the spring 7 tends to pull the second jaw 2 toward the first jaw 1. The release lever 6 is pivotally connected with the second handle 3 by means of a rivet. A first end of the release lever 6 abuts the toggle 4. The pair of locking pliers clamps an object between the jaws 1 and 2. To release the object from the jaws 1 and 2, a second end of the release lever 6 is pressed so that the first end of the release lever 6 lifts the toggle 4. Thus, the second handle 3 pivots from the toggle 4, and the second jaw 2 from the first jaw 1. A gap exists between the second handle 3 and the release lever 6. A user's finger might enter this gap and get clamped and hurt by means of the second handle 3 and the release lever 6. Moreover, the user's hand might slide on the handles 8 and 3 that are made of metal, thus causing troubles for the user in operation.

The present invention is therefore intended to obviate or at least alleviate the problems encountered in the prior art.

SUMMARY OF INVENTION

It is an objective of the present invention to provide a pair of locking pliers.

According to the present invention, a pair of locking pliers includes a first jaw, a first handle, a second jaw, a second handle, a toggle, an adjusting screw, a release lever, a spring, and a soft jacket. The first handle extends from the first jaw and includes a space defined therein. The second jaw is pivotally connected with the first jaw. The second handle is pivotally connected with the second jaw. The toggle includes a first end pivotally connected with the second handle and a second end inserted into the space of the first handle. The adjusting screw includes an end driven into the space of the first handle for abutment against the second end of the toggle. The release lever is pivotally connected with the second handle. The release lever includes a first end for abutment against the toggle and a second end to be pressed by a user. The spring includes an end secured to the first handle and an opposite end secured to the second jaw. The soft jacket wraps up the second handle and the release lever.

Other objectives, advantages and novel features of the invention will become apparent from the following detailed description when taken in conjunction with the attached drawings.

DETAILED DESCRIPTION OF PREFERRED EMBODIMENTS

Figure 1:
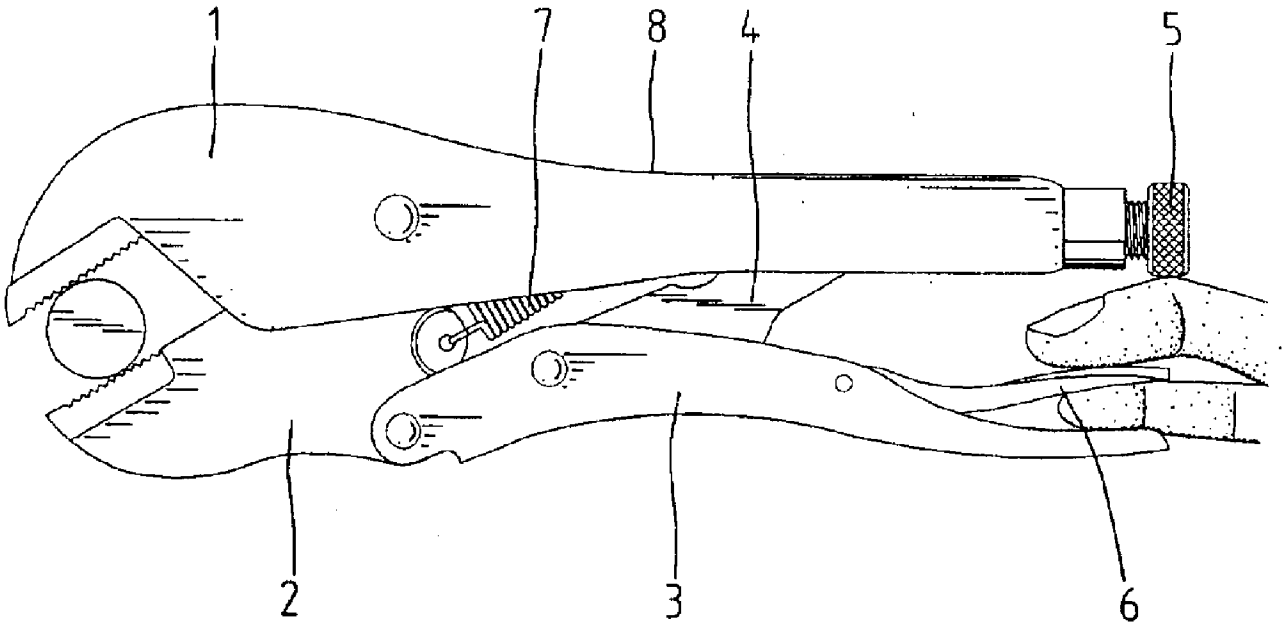
Fig. 1 PRIOR ART
FIG. 1 is a side view of a conventional pair of locking pliers.
Figure 2:
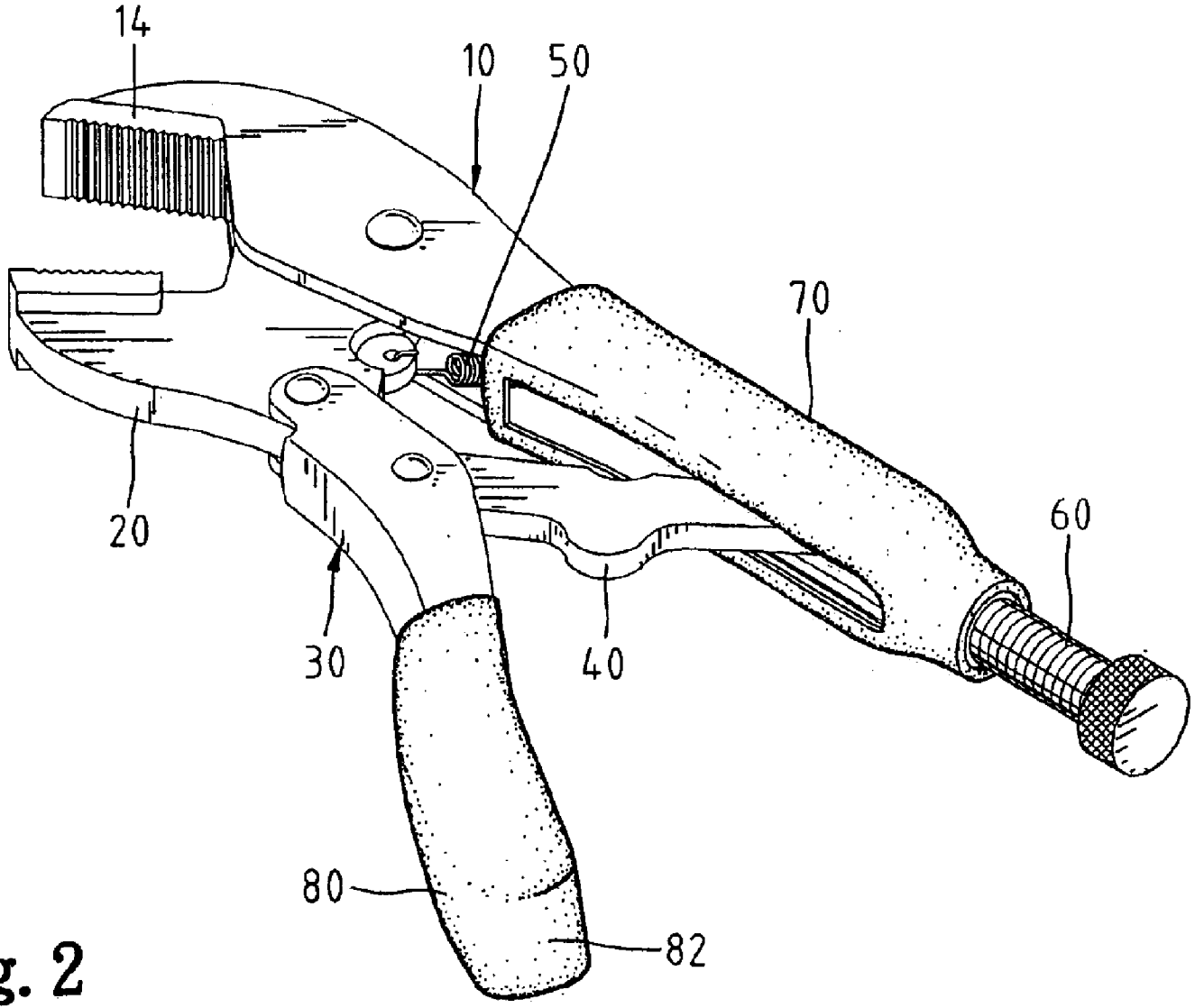
FIG. 2 is a perspective view of a pair of locking pliers according to the present invention.
Figure 3:
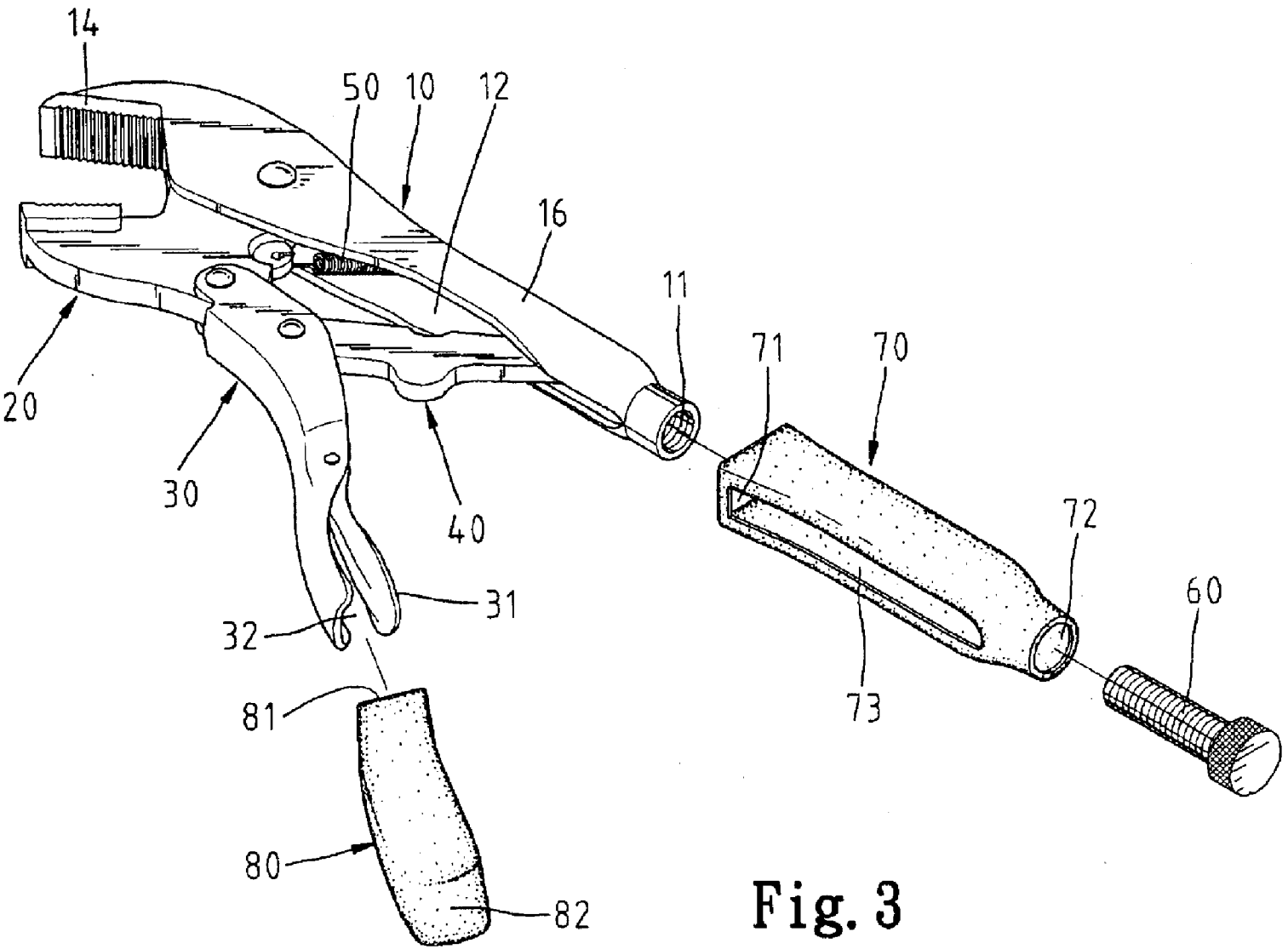
FIG. 3 is an exploded view of a pair of locking pliers according to the present invention.

Referring to FIGS. 2 and 3, according to the preferred embodiment of the present invention, a pair of locking pliers includes a first jaw 14, a first handle 16, a second jaw 20, a second handle 30, a toggle 40, an adjusting screw 60, a release lever 31, a spring 50, a first soft anti-slip jacket 70, and a second soft anti-slip jacket 80.

The first handle 16 extends from the first jaw 14. Preferably, they are merged into one piece 10. The first handle 16 is hollow, i.e., defining a space 12 for receiving the spring 50 and the toggle 40. A hole 11 is defined in an end of the first handle 16 in order to receive the adjusting screw 60.

The second jaw 20 is pivotally connected with the first jaw 14 by a rivet (not numbered).

The second handle 30 is pivotally connected with the second jaw 20 by a rivet (not numbered).

A first end of the toggle 40 is pivotally connected with the second handle 30 by a rivet. A second end of the toggle 40 is inserted into the space 12 of the first handle 16.

The adjusting screw 60 is driven into the hole 11. An end of the adjusting screw 60 abuts the second end of the toggle 40. The adjusting screw 60 can be driven in a direction into the space 12 through the hole 11 so as to push the second end of the toggle 40. The toggle 40 in turn pivots the second lever 30 from the first handle 16. The adjusting screw 60 can be driven in an opposite direction, thus allowing the second handle 30 to pivot toward the first handle 16.

The release lever 31 is pivotally connected with the second handle 30 by a rivet (not numbered). A first end of the release lever 31 abuts the toggle 40. To release the object from the jaws 10 and 20, a second end of the release lever 31 is pressed so that the first end of the release lever 30 lifts the toggle 40. Thus, the second handle 30 pivots from the toggle 40, and the second jaw 20 from the first jaw 14.

Figure 4:
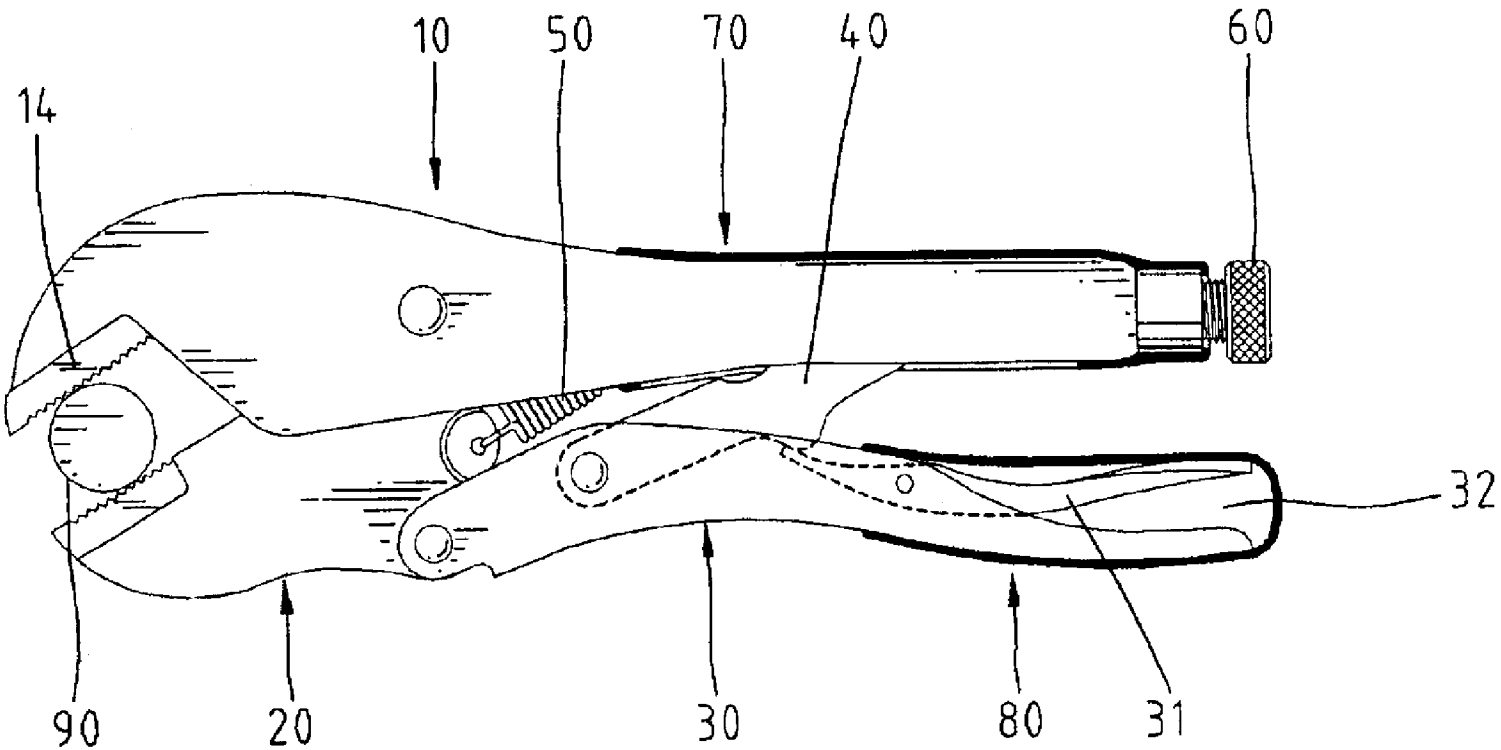
FIG. 4 is a side view of a pair of locking pliers according to the present invention.

An end of the spring 50 is secured to the second jaw 20. An opposite end of the spring 50 is secured to the first handle 16. Thus, the spring 50 tends to pull the second jaw 20 toward the first jaw 14. The pair of locking pliers clamps an object 90 between the jaws 14 and 20 as shown in FIG. 4.

The first anti-slip jacket 70 is hollow. The first anti-slip jacket 70 provides a rough surface on which a hand does not slip. The first anti-slip jacket 70 includes an open end 71 and an opposite open end 72. A slot 73 is defined in a side of the first anti-slip jacket 70. The first handle 16 is inserted into the anti-slip jacket 70 through the open end 71. Adhesive may be provided between the first handle 16 and the anti-slip jacket 70 so that the anti-slip jacket 70 is secured to the first handle 16. The toggle 40 extends through the slot 73. The adjusting screw 60 extends through the open end 72.

Figure 5:
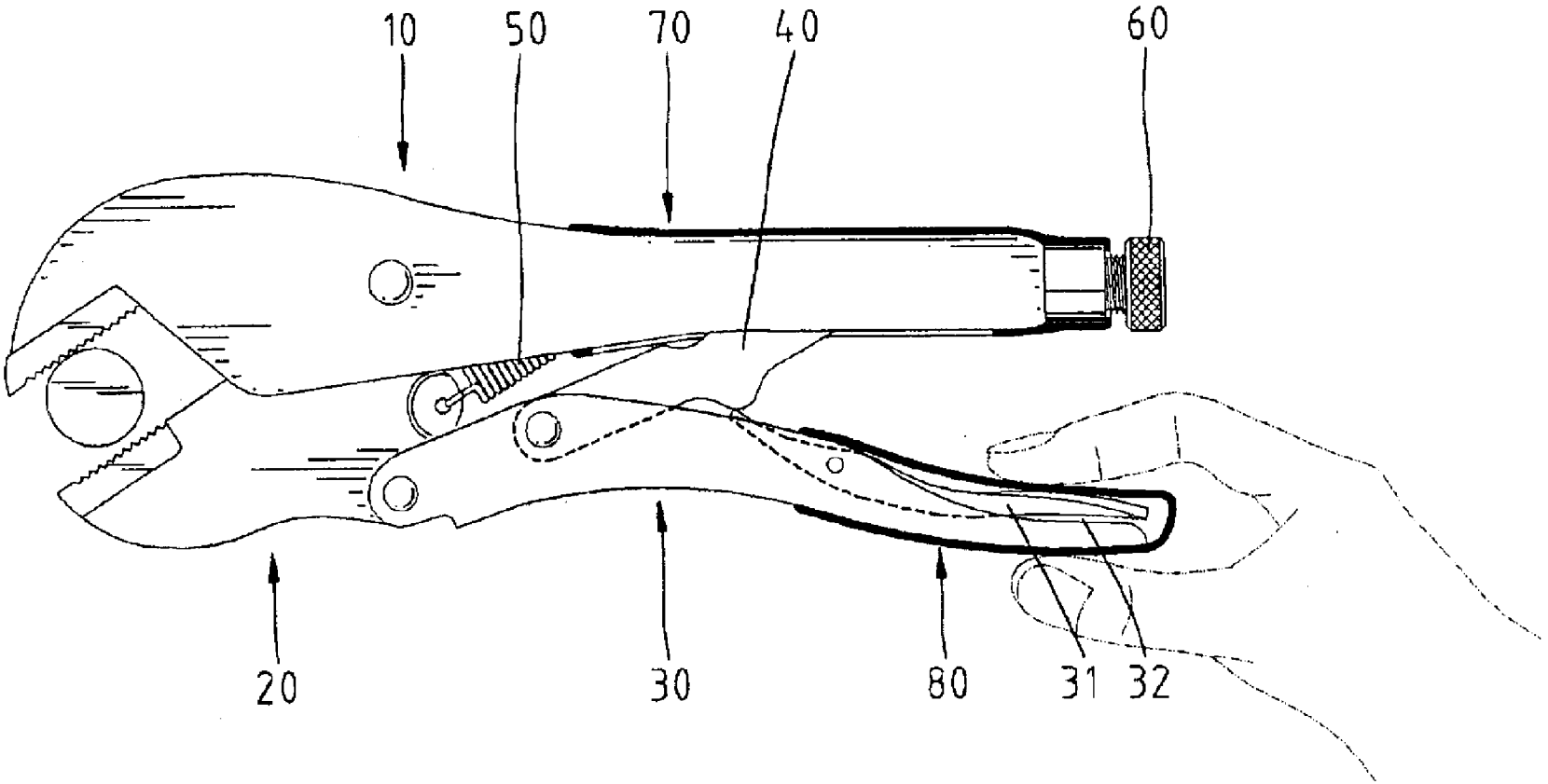
FIG. 5 is similar to FIG. 4 but showing a pair of locking pliers in the open position.

The second anti-slip jacket 80 is hollow. The second anti-slip jacket 80 provides a rough surface on which the hand does not slip. The second anti-slip jacket 80 includes an open end 81 and an opposite closed end 82. The second handle 30 and the release lever 31 extend into the second anti-slip jacket 80 through the open end 81. Thus, the second anti-slip jacket 80 wraps up the second handle 30 and the release lever 31 (see FIGS. 4 and 5). A gap 32 existing between the second handle 30 and the release lever 31 is shielded. Thus, the fingers cannot enter the gap 32 and will not be clamped between and by the second handle 30 and the release lever 31.

The present invention has been described through detailed illustration of the preferred embodiment. Those skilled in the art can derive many variations from the preferred embodiment without departing from the scope of the present invention. Therefore, the preferred embodiment shall not limit the scope of the invention. The scope of the present invention is defined in the attached claims.

What is claimed is:

1. A pair of locking pliers including:

a first jaw;

a first handle extending from the first jaw and including a space defined therein;

a second jaw pivotally connected with the first jaw;

a second handle pivotally connected with the second jaw;

a toggle including a first end pivotally connected with the second handle and a second end inserted into the space of the first handle;

an adjusting screw including an end driven into the space of the first handle for abutment against the second end of the toggle;

a release lever pivotally connected with the second handle and formed with a first end for abutment against the toggle and a second end to be pressed by a user;

a spring including an end secured to the first handle and an opposite end secured to the second jaw; and an anti-slip jacket wrapping up the first handle, wherein the anti-slip jacket includes a first open end defining an aperture through which the first handle extends, a second open end through which the adjusting screw extends and a slot through which the second end of the toggle extends.

2. The pair of locking pliers according to claim 1 further including:

a soft jacket wrapping up the second handle and the release lever.

3. The pair of locking pliers according to claim 2 wherein the anti-slip jacket provides a rough surface.

4. The pair of locking pliers according to claim 2 wherein the soft jacket provides a rough surface.

5. The pair of locking pliers according to claim 4 wherein the anti-slip jacket provides a rough surface.

6. The pair of locking pliers according claim 1 wherein the anti-slip jacket provides a rough surface.

* * * * *